US005460491A

United States Patent [19]

Kitsnik

[11] Patent Number: 5,460,491

[45] Date of Patent: Oct. 24, 1995

[54] DISPLACEMENT PUMP AS WELL AS A PUMP ASSEMBLY COMPRISING TWO DISPLACEMENT PUMPS

[76] Inventor: Henrik Kitsnik, Tallbachen, S-660 40 Segmon, Sweden

[21] Appl. No.: 305,597

[22] Filed: Sep. 14, 1994

Related U.S. Application Data

[62] Division of Ser. No. 39,293, Apr. 19, 1993, abandoned.

[51] Int. Cl.[6] ..... F04B 35/02

[52] U.S. Cl. ..... 417/403; 417/426; 91/536

[58] Field of Search ..... 417/401, 403, 417/426; 91/536

[56] References Cited

U.S. PATENT DOCUMENTS

| | | | |
|---|---|---|---|
| 4,097,198 | 6/1978 | Herron | 417/401 |
| 4,455,921 | 6/1984 | Griesbach | 91/536 |
| 4,477,232 | 10/1984 | Mayer | 417/403 |
| 4,701,112 | 10/1987 | Eisenhunt et al. | 417/403 |
| 4,856,967 | 8/1989 | Jones | 417/401 |
| 5,222,873 | 6/1993 | Whitehead et al. | 417/426 |
| 5,315,916 | 5/1994 | Foster | 91/536 |
| 5,331,842 | 7/1994 | Wellemeyer | 417/401 |
| 5,348,451 | 9/1994 | Mohn | 417/403 |

FOREIGN PATENT DOCUMENTS

| | | | |
|---|---|---|---|
| 1008300 | 4/1977 | Canada . | |
| 1051264 | 8/1979 | Canada . | |
| 3448016 | 6/1986 | Germany | 417/403 |
| 0400507 | 12/1990 | Germany | 417/403 |

*Primary Examiner*—Richard A. Bertsch
*Assistant Examiner*—Peter G. Korytnyk
*Attorney, Agent, or Firm*—Nixon & Vanderhye

[57] ABSTRACT

The invention relates to a pump assembly comprising first and second pump units designed to be driven hydraulically, consisting of pump housing chambers, pump housing cylinders with pumping plungers mounted therein, and hydraulic cylinders with driving chambers which can be connected to a pressure source through a control valve for developing in the driving chambers a certain hydraulic pressure, which is used to operate the driving plungers.

8 Claims, 10 Drawing Sheets

58'
21
19'
20
18'
17'
94
26'
6'
26'a
7'
86'
32
33
36
35
34
38'
24'
20
24a'
25b'
22'
94
25'
28'
25a'
17'

DISPLACEMENT PUMP AS WELL AS A PUMP ASSEMBLY COMPRISING TWO DISPLACEMENT PUMPS

This a Rule 60 Division of application Ser. No. 08/039,293, filed 19 Apr. 1993, now abandoned.

TECHNICAL FIELD

The present invention relates to a displacement pump, particularly a plunger pump, designed to be driven hydraulically, comprising at least one pump housing with a pump housing chamber, a pump housing cylinder and a plunger disposed in the pump housing cylinder, which plunger during the pump stroke is driven into the pump housing chamber, a driving unit designed for the respective plunger and comprising a hydraulic cylinder with a driving piston in the hydraulic cylinder as well as a driving rod mounted between the driving piston and the plunger.

Also, the invention relates to a pump assembly comprising two pump units, designed as displacement pumps, each one comprising at least one pump housing chamber, one pump housing cylinder and a displacement element mounted in the pump housing cylinder, e.g. a plunger, a piston or a membrane, which during the pump stroke is driven into the pump housing chamber, a driving unit belonging to each displacement element comprising a hydraulic cylinder with a driving piston mounted in the hydraulic cylinder and a driving rod mounted between the driving piston and the displacement element.

BACKGROUND ART

Displacement pumps are known and designed in many ways. Among the main types of displacement pumps membrane pumps, piston pumps and plunger pumps can be mentioned. A piston is defined in this text as a piston provided with one or several sealing elements, which interact with a smooth cylinder wall, whereas a plunger in this text is defined as a piston having a smooth, cylindrical outer surface, which interacts with one or several sealing elements, mounted in a cylindrical wall, which does not have to be smooth. Thus, a piston is in this context a machine element, which can function as either a piston or a plunger.

Piston pumps are probably the types of displacement pumps most frequently used. In comparison with e.g. the membrane pump the piston pump has the advantage, that it is possible to work with comparatively small surfaces exposed to the pump medium. Thus, the forces exerted on the pump housing do not have to be very large and thus, there are no high requirements as to the thickness of material in the pump housing, which consequently can be made comparatively light-weight. On the other hand it is necessary to work with comparatively large stroke lengths. Along all this length the pump housing cylinder must be very smooth in order to be able to interact efficiently with the sealing device or sealing devices on the pump piston. This results in considerable problems in practice. One device designed to solve these problems and which also has succeeded in doing so is described in U.S. Pat. No. 4,519,753. This device has meant a substantial technical progress. This is particularly true as regards a pumping at very high pressures and/or a pumping of slurries of various types. However, this device is comparatively complicated and hence comparatively expensive to produce, partly due to the plurality of pistons, which the system must comprise, and partly because of the high tolerance requirements called for when the pump housing cylinder is manufactured.

As regards plunger pumps some of the difficulties typical of piston pumps can be avoided. However, plunger pumps also have a few problems. This is particularly true as regards plunger pumps performing in strongly contaminated or abrasive media, such as slurries of various types, e.g. cement. Ths basic reason for this is that the plunger during the pump stroke is driven into the pump housing chamber. During the return stroke it is necessary to prevent the pump fluid from coming along past and/or from damaging the sealing devices in the cylinder wall. It has not been possible to solve these difficulties in a satisfactory way in the known devices.

Another problem typical of not only plunger pumps but also other displacement pumps is the pulsating mode of operation. As is the case with the majority of other pump types it is desirable that the pump does not work discontinuously but as evenly as possible. By making two pump units (pump cylinders) work alternatingly in an integrated pump assembly it is possible to reduce the pulsations to a large extent. Regarding mechanically driven displacement pumps there exists certain geometrical relationships between the number of pump cylinders and the degree of non-uniformity, i.e. the variations of the pump flow during a pump cycle. Thus, although it is possible to reduce these variations quite substantially by using a larger amount of cylinders, it is never possible to avoid said geometrical relationships and the corresponding pump flow pulsations. As regards hydraulically driven pumps these inevitable relationships can be broken, since the cylinders can be driven independent of each other, but the problem with pulsations has not been solved in a satisfactory way as regards hydraulically driven displacement pumps according to the state of the art.

BRIEF DISCRIPTION OF THE INVENTION

The object of the present invention is to achieve improvements in displacement pumps and particularly in plunger pumps. Particularly, the object of the invention is to solve the above-mentioned problems. These and other objects can be achieved in accordance with the present invention and through what is set forth in the following patent claims.

The most important improvement in this matter relates to arrangements of sealing devices for the plunger as well as devices designed to, by means of rinsing water, keep these sealing devices clean in order to substantially reduce the wear of the plunger and its sealings, when liquids are pumped, which contain solid particles or other abrasive media.

Also, the object is to suggest a pump assembly having very small flow pulsations, despite the fact, that the assembly principally only comprises one single-acting cylinder couple, i.e. two cylinders.

Additional objects as well as characteristic features and aspects of the invention will be set forth in the following description of a few preferred embodiments.

BRIEF DESCRIPTION OF THE DRAWINGS

In the following description of preferred embodiments reference will be made to the accompanying drawings, in which.

DESCRIPTION OF PREFERRED EMBODIMENTS

Figure 1A:
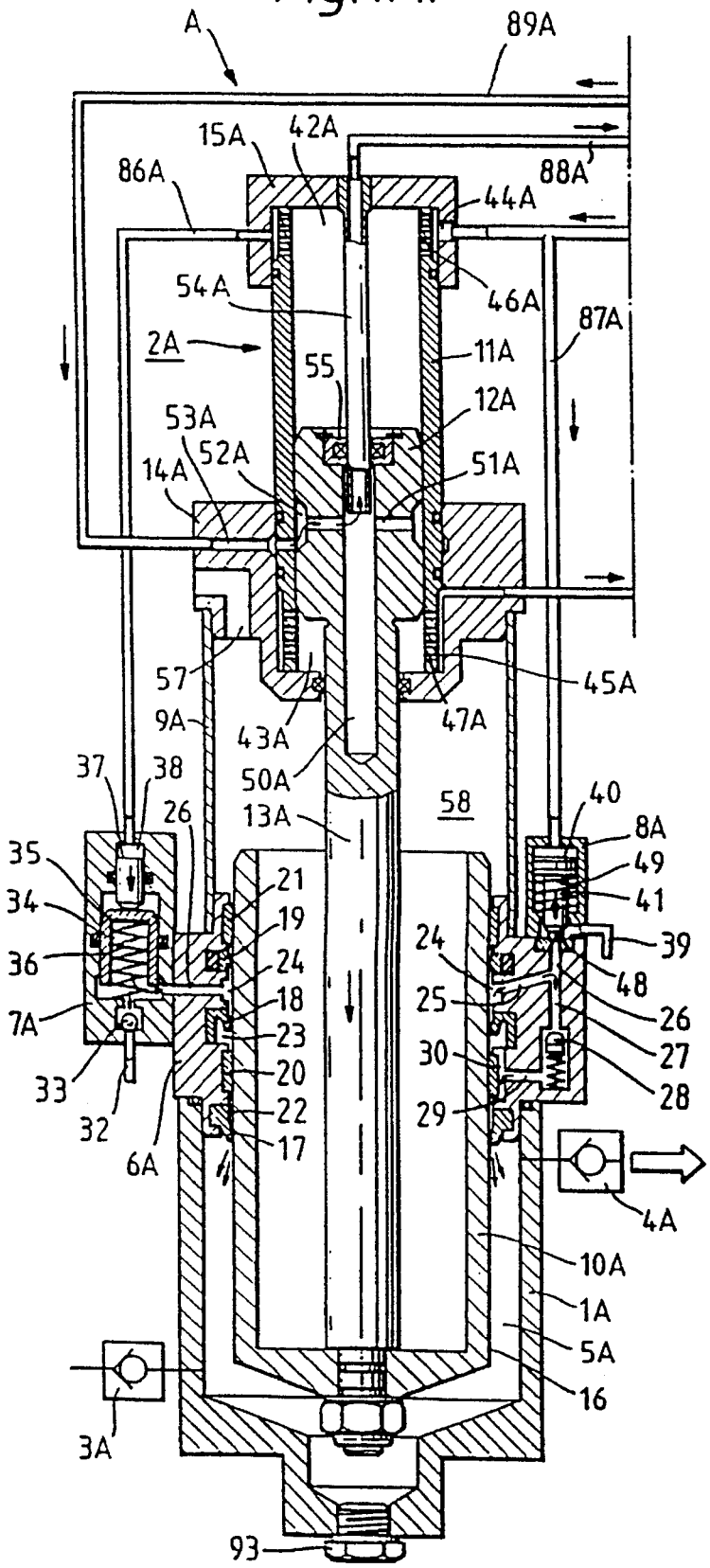
FIG. 1A–1C schematically shows how two pump units or cylinders, designed to function at moderate pump medium pressures in a two-cylinder plunger pump assembly according to the invention, are constructed and designed to interact during the sequence of operation.
Figure 1A:
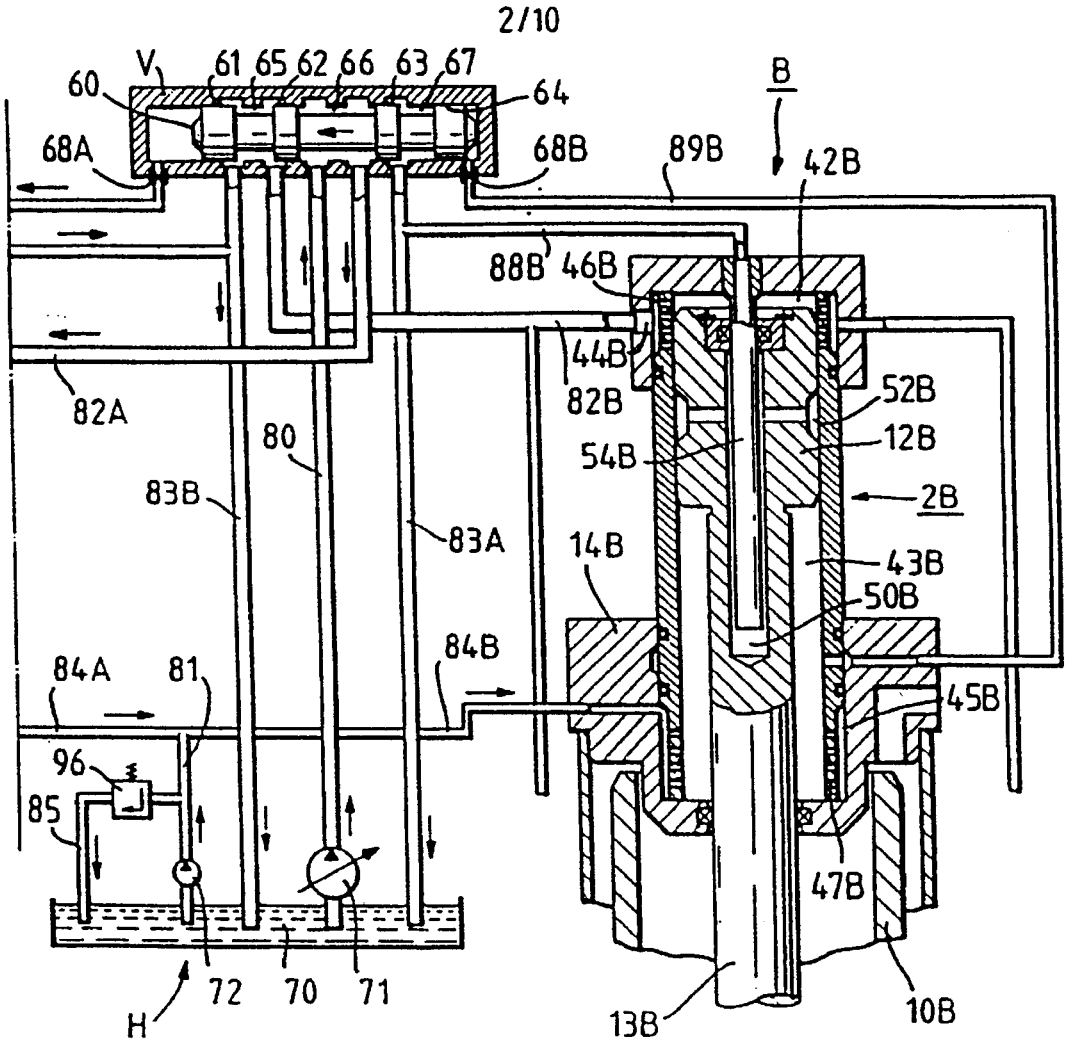

The plunger pump assembly comprises according to a first preferred embodiment two pump units or cylinders A,B, the shiftings of which are controlled by a common, particularly designed sliding valve V. The equipment also includes a hydraulic assembly, which generally is designated H. The two pump units A and B are identically designed and equipped. Thus, in the following text only one of the pump units, the A-unit, will be described in more detail. When it is required to understand the functional description, numerical references to elements belonging to the A-unit have been given the addition A, whereas the corresponding elements of the B-unit have obtained the addition B in the drawings and/or in the text.

The A-unit comprises a pump housing 1A and a driving unit 2A. Pump housing 1A includes a pump housing chamber 5A having an inlet conduit with a nonreturn valve 3A and an outlet conduit with a nonreturn valve 4A. A sealing housing 6A is connected to pump housing 1A and is an integrated part of pump housing 1A and forms a continuation of the cylinder-shaped pump housing chamber 5A, but its interior dimensions are smaller. A rinsing water housing 7A and a draining housing 8A are connected to sealing housing 6A. A housing or spacing piece between driving unit 2A and the pump housing and its sealing housing 6A is designated 9A. A plunger is designated 10A.

Driving unit 2A comprises the following main elements: a hydraulic cylinder 11A, a driving piston 12A, a driving rod 13A, which connects driving piston 12A to plunger 10A, an end block 14A and a top lid 15A. Elements 1A, 6A, 7A, 8A,9A,11A,14A,15A are connected to each other by means of bolted joints to one unit. In this stationary unit the unit, which comprises plunger 10A, driving piston 12A and driving rod 13A, is movable between two end positions.

Plunger 10A has a smooth cylindrical exterior surface, which is designed to interact with a number of annular or sleeve-shaped sealings in sealing housing 6A, which also is a part of the pump housing cylinder. Adjacent pump housing chamber 5A there is a first sealing sleeve 17, which is a combined main sealing and wiper. A secondary sealing sleeve is designated 18 and a third sealing is designated 19. The latter seals against the ambient air, which fills the space 58 inside spacing piece 9A. A lower guide between sealing sleeves 17 and 18 is designated 20 and an upper guide outside sealing 19 is designated 21.

Elements 17–21 are placed in annular grooves in sealing housing 6A. Also, the interior wall of sealing housing 6A has a profile in cross-section, in which there is an annular gap-shaped space 22 inside and above the combined main sealing, comprising wiper 17, an annular recess 23 inside and below secondary sealing 18 and an annular space 24 between secondary sealing 18 and third sealing 19, which is turned outwards.

From rinsing water housing 7A a conduit 26 leads to annular space 24 and from this space a conduit 25 leads, branching off into a conduit 26 up towards draining housing 8A and a conduit 27 downwards to a nonreturn valve 28, on the downstream-side of which there is a conduit 29, which via a connection conduit 30 leads to annular spaces 22 and 23.

An inlet conduit 32 for rinsing water is extended via a nonreturn valve 33 into a rinsing water chamber 34, which communicates with the above-mentioned conduit 26, which is extended into annular space 24 in sealing housing 6A. In rinsing water chamber 34 there is a rinsing plunger 35 with a screw-wound spring 36 on its inside, which strives to push plunger 35 upwards against a hydraulic, small control plunger 37, mounted in a hydraulic control cylinder 38.

Draining housing 8A comprises a cylinder with a hydraulic piston 40 having a hydraulic rod 41, which exerts a pressure against a nonreturn valve ball 48, which in FIG. 1A blocks the passage between conduit 26 and a draining conduit 39. A return spring for piston 40 is designated 49.

Hydraulic cylinder 11A in driving unit 2A is on one side of piston 12A provided with a driving or plus chamber 42A and on the other side with a return or minus chamber 43A. Inside top lid 15A and inside the end portion of end block 14A respectively there is an annular gap 44A and 45A respectively, which communicates with driving chamber 42A and with return chamber 43A respectively through a number of openings 46 and 47 respectively, which extend along a portion of hydraulic cylinder 11A from its two ends.

Piston 12A has an axial cavity 50A, which also extends a small distance into driving rod 13A. Cavity 50A communicates via ducts 51A with an annular gap 52A in the middle of piston 12A. A duct, which extends through hydraulic cylinder 11A of the driving unit a small distance from outer gap 45A of the return chamber, is designated 53A. In top lid 15A there is a central opening, into which a tube 54A is screwed, which has the same length as and extends into axial cavity 50A in driving piston 12A and driving rod 13A. A sealing between the outer side of tube 54A and the outer end of space 50A is designated 55.

A large aeration duct 57 connects space 58 inside housing 9A with the outside.

In central valve V there is a slide 60, which is provided with a first, a second, a third and a fourth flange 61–64, designed to slide along the inside of the valve housing. Between said flanges there is a left annular recess 65, a central annular recess 66 and a right annular recess 67.

Hydraulic assembly H includes according to this embodiment a sump 70, a first hydraulic pump 71, which is the main pump in the system and an auxiliary pump 72.

The system comprises a number of hydraulic conduits. Those conduits, which mainly are connected to the A-unit, have obtained the addition A, and those which mainly belong to the B-unit have been given the designation B.

A main conduit 80 leads to control valve V, and the hydraulic oil, which flows through conduit 80, can via central recess 66 in slide 60 be distributed either to a driving conduit 82A to gap 44A or to a driving conduit 82B to a corresponding gap 44B in the B-unit, or via the two driving conduits 82A and 82B to the two units A and B, dependent on the position of slide 60. The hydraulic oil in driving chambers 42A and 42B can also be emptied through conduits 82A and 82B via said right recess 67 and a draining conduit 83A as well as via said left recess 65 and a draining conduit 83B respectively. Return chambers 43A and 43B can at the return stroke be filled with hydraulic oil by means of auxiliary pump 72 via a conduit 81 and a conduit 84A, which leads to gap 45A, and via conduit 81 and a conduit 84B which leads to gap 45B respectively. At the pump stroke the oil in return chambers 43A and 43B can be emptied in the same way. However, the oil from conduit 81 flows to sump 70 via a conduit 85 past an overflow valve 96. As is shown in the drawings, gaps 45A and 45B communicates directly with each other via conduits 84A and 84B, which belong to the common pressurized return system, in which a constant pressure is maintained by pump 72 and overflow valve 96.

From gap 44A in the rear end portion of hydraulic cylinder 11A a conduit 86A leads to control cylinder 38 in rinsing water housing 7A. From conduit 82A (or from the same gap 44A) a conduit 87A leads to the cylinder in draining housing 8A. From conduit 83B a conduit 88A leads to central tube 54A. Finally, a control conduit 89A and 89B respectively leads from duct 53A in end block 14A as well as from the corresponding duct in the B-unit respectively to the respective ends of control valve V respectively. In control conduits 89A and 89B there is a restriction 68A and 68B respectively.

Those pump units, which have been described with reference to FIGS. 1A–1C and FIG. 4 are particularly designed to be used when the pump medium has a moderate pressure, i.e. up to a maximum of 100 bar, e.g. 50–60 bar, but it is possible to use a considerably higher hydraulic pressure in order to, by reducing the pump medium pressure, instead increase the outlet flow of the pump as compared to the driving oil flow.

The mode of operation of the described equipment will now be explained. The starting position is assumed to be that moment, which immediately precedes the situation shown in FIG. 1A. Slide 60 is in its right position and hydraulic oil is driven by pump 71 through conduit 80, gap 66 and conduit 82A to driving chamber 42A and pushes driving piston 12A forwards, and in this way plunger 10A is driven forwards (downwards in FIG. 1A) in pump housing chamber 5A. Nonreturn valve 3A is closed and the pump medium is pressed out of pump housing chamber 5A via valve 4A. Conduit 89A is blocked by piston 12A. Driving piston 12B in the B-unit is returning and approaching its rear end position. Return chamber 43B is fed with hydraulic oil from return chamber 43A of the A-unit, from which the hydraulic oil is pressed out via conduit 84A. Auxiliary pump 72 contributes to maintaining the pressure in return system 43A–43B. A certain amount of oil is recirculated through conduit 85. The hydraulic oil in driving chamber 42B of the B-unit is drained through conduit 82B, gap 65 and draining conduit 83B. The oil in cavity 50B and in tube 54A is drained through conduits 88B,83A. This phase is indicated by the continuously drawn horizontal curve of the A-unit and the dashed line-drawn inclined curve of the B-unit to the left of position I in FIG. 2A. The inclination of the curve depends on the movement of driving piston 12B within the area of openings 45B inside gap 44B, a successive throttling of the hydraulic oil flow being obtained (Position I is that position, in which driving piston 12B reaches its upper/rearmost end position, which takes place when plunger 10B hits end block 14B).

Figure 2A:
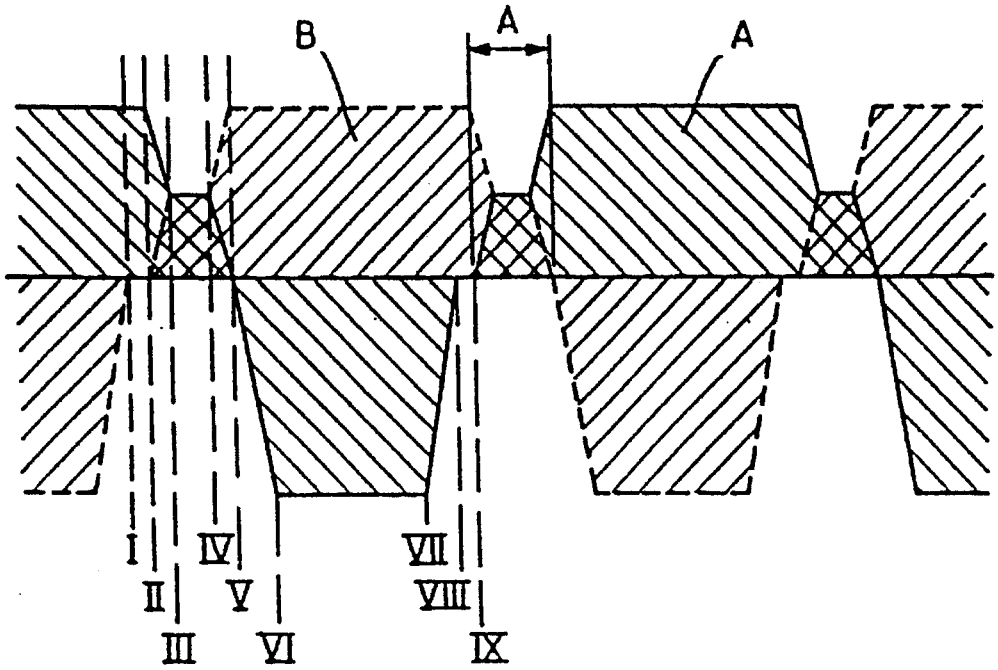
FIG. 2A–2B is a diagram, which illustrates the flow of the pump medium in the two pump units in the integrated two-cylinder plunger pump assembly during a work cycle.

When driving piston 12A and its annular gap 52A reaches and starts comunicating with conduit 53A, which roughly corresponds to position I in the diagram in FIG. 2A, the following will happen: The pressure on the left side of slide 60 in control valve V decreases, since the hydraulic medium to the left of slide 60 can be drained through conduits and ducts 89A, 53A, 51A, 54A, 88A, 83B to sump 70. At the same time a pressure on the right side of slide 60 via control conduit 89B remains, which causes slide 60 to start moving to the left. However, this movement is comparatively slow due to restrictions 68A and 68B.

During the movement of slide 60 to the left the following sequence is obtained:

POSITION I-II

In position I driving piston 12B reaches its upper end position and remains in this position up to position II, while driving piston 12A continues to move forwards an additional distance with the same speed up to position II. Flange 62 closes the connection between conduit 82B and draining conduit 83B.

POSITION II-III

Flange 62 passes conduit 82B, and now hydraulic oil from main conduit 80 can be distributed to the two conduits 82A and 82B via central gap 66 in valve V. Thus, the B-unit is pressurized through driving chamber 42B, which means that driving piston 12B starts its movement forwards (downwards, FIG. 1). Since main pump 71 feeds a constant flow of hydraulic fluid through conduit 80, the feeding to driving chamber 42A will decrease with the same amount which is now fed into driving chamber 42B in the B-unit, which corresponds to the inclined portions and curves in FIG. 2A between positions II and III, and means that driving piston 12B is accelerating, while driving piston 12A is decelerating to the same extent.

POSITION III-IV

Figure 1B:
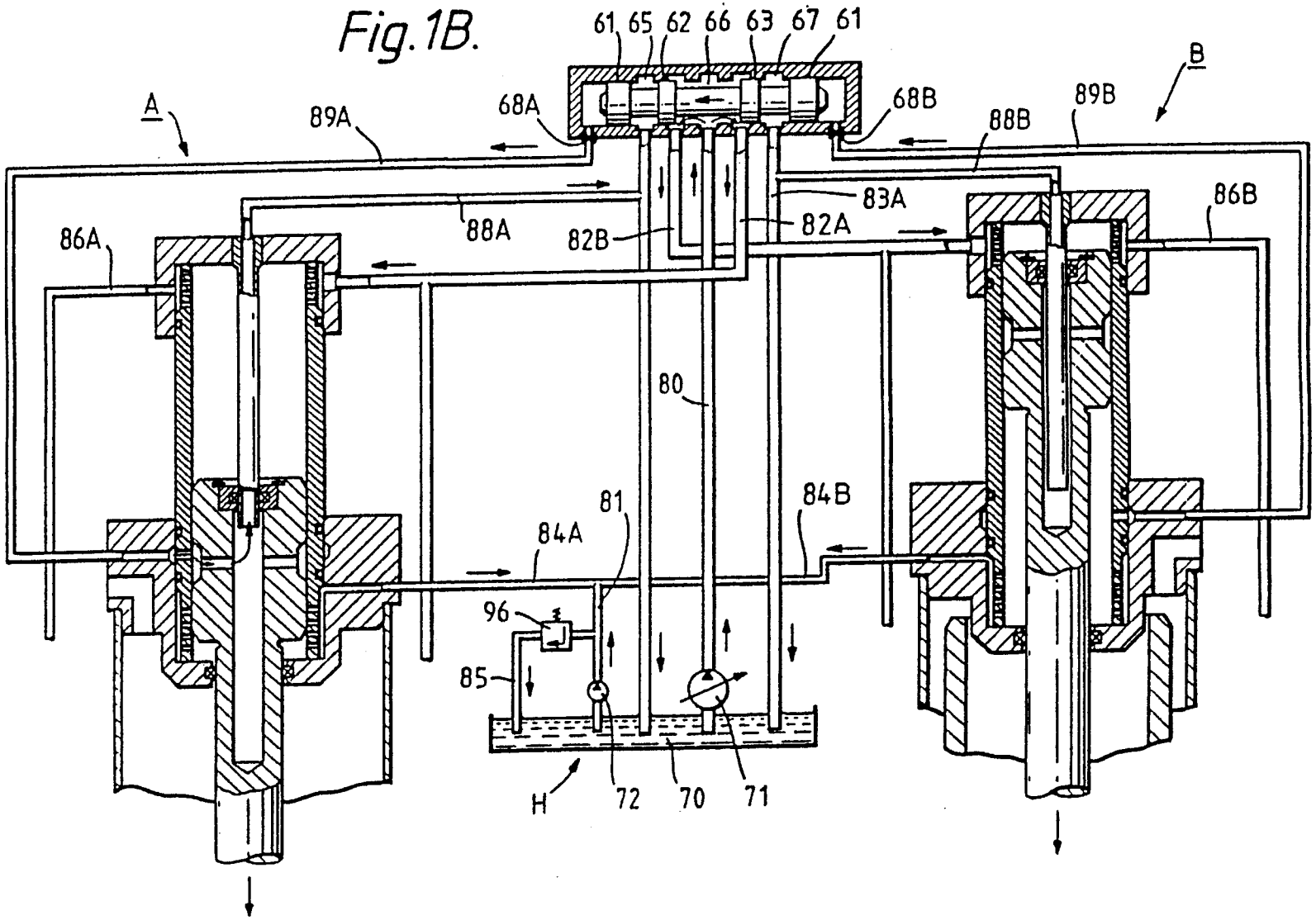
Figure 1C:
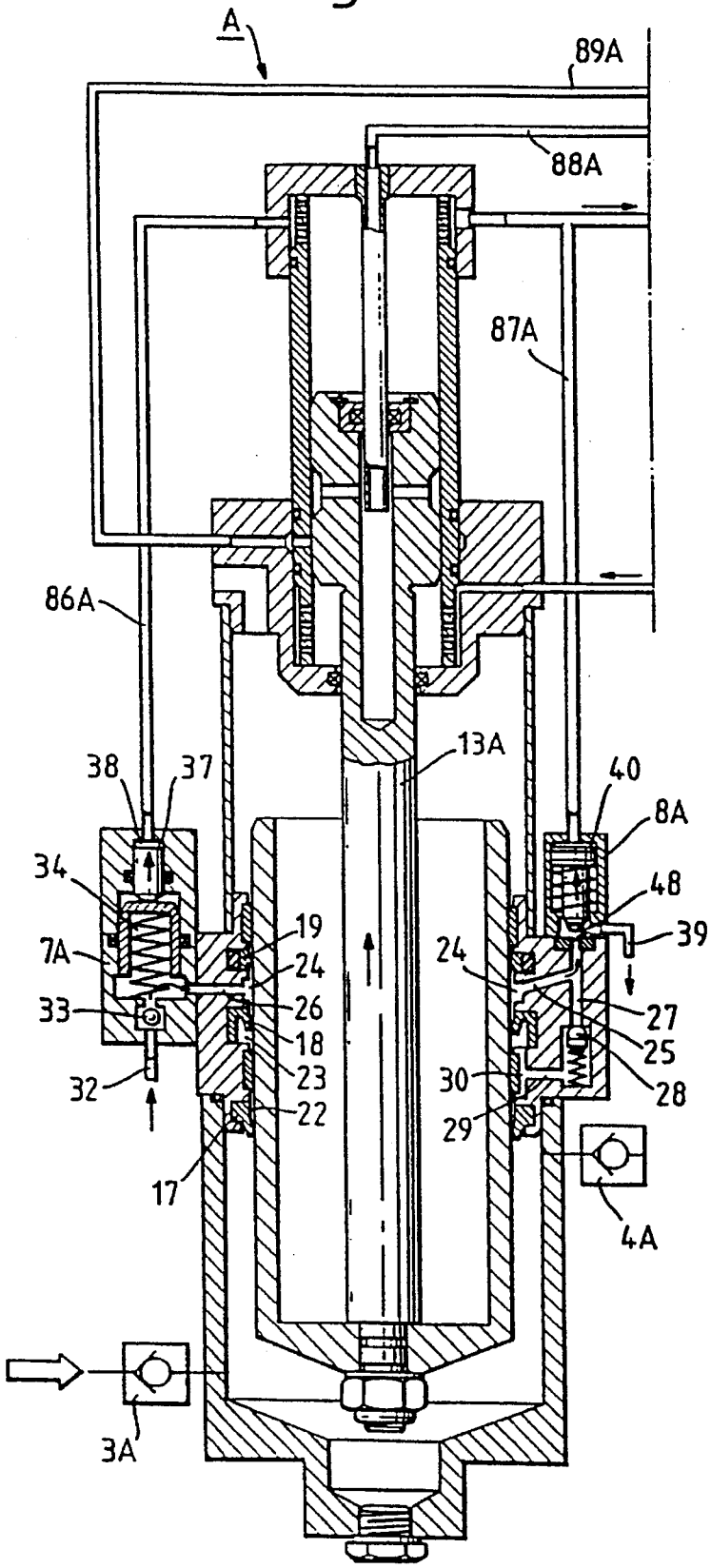
Figure 1C:
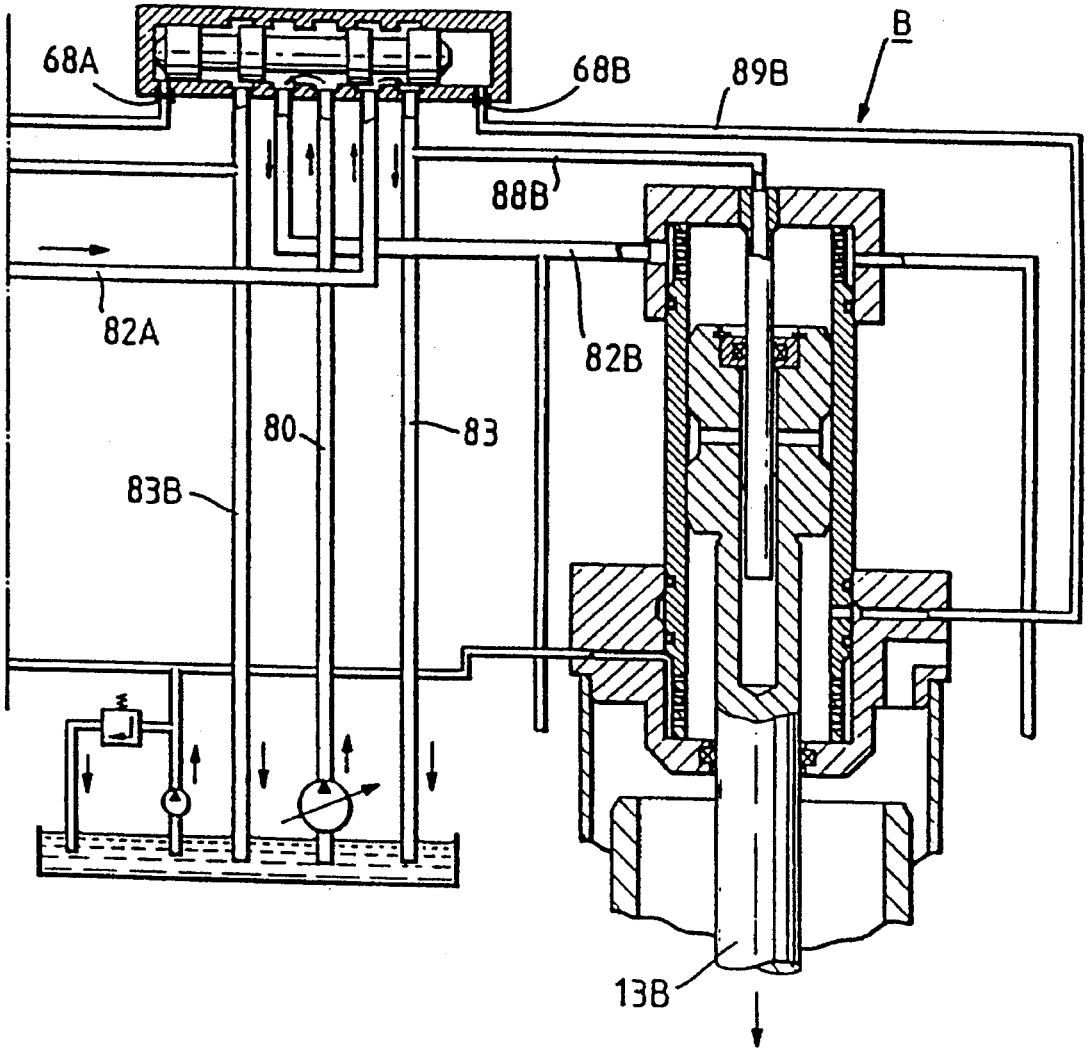

During this phase, during which slide 60 is passing the position shown in FIG. 1B, the hydraulic fluid is distributed from conduit 80 mainly in the same amount to driving chamber 42A of the A-unit and to driving chamber 42B of the B-unit respectively, which is indicated by the coinciding, horizontal part of the curves between positions III and IV in FIG. 2A. This idealized situation is also shown in FIG. 1B. Return chambers 43A and 43B are drained through conduits 84A, 84B, 81 and 85. The hydraulic oil is pressed out of return chambers 43A and 43B through conduits 84A, 84B, 81 and through overflow valve 96.

POSITION IV-V

Between positions IV and V flange 63 starts closing conduit 82A to driving chamber 42A of the A-unit, and in position V connection 82A is completely closed, which implies that driving piston 12A and plunger 10A have stopped in their formost end positions, while driving piston 12B and plunger 10B of the B-unit has accelerated to their full speed during their pump stroke.

During the entire sequence of operations described so far, i.e. from the moment before position I and between positions I and V a hydraulic overpressure Ph in driving chamber 42A has been maintained and then also in control conduit 86A. The same pressure Ph is also maintained in conduit 87A. Thus, pressure Ph actuates partly control plunger 37 in control cylinder 38 in rinsing water housing 7A and partly piston 40 in draining housing 8A. The cross-sectional areas of control plunger 37, rinsing chamber plunger 35, driving piston 12A and main plunger 10A are called Y37, Y35, Y12A and Y10A respectively. According to one aspect of the invention the area ratios must fulfill the requirement Y37:Y35>Y12A:Y10A. More clearly expressed, the Y-ratio Y37:Y35 is to be larger than the ratio Y12A:Y10A to such an extent that the pressure Pv on the rinsing water in rinsing water housing 7A (also considering the force exerted by spring 36 and various other factors) is somewhat larger than pressure Pp on the pump medium in pump housing chamber 5A. At the same time pressure Ph will be sufficiently large to be able to, via conduit 87A and piston 40, compress spring 49 in draining housing 8A and close nonreturn valve 42. Thus, when control plunger 37 is actuated by the pressure in control cylinder 38, it will press rinsing plunger 35 against spring 36. Nonreturn valve 33 will be closed. The obtained pressure in rinsing water chamber 34 is propagated through conduit 26 in sealing housing 6A into gap 24 and from the gap through ducts 25 and 27, past nonreturn valve 28 and through duct 29 into duct 22 inside and behind the combined primary sealing and wiper 17. In case the pressure difference between the rinsing water pressure in gap 22 and the pump medium pressure in pump housing chamber 5A would be larger than the contact force for the wiper lip on primary sealing 17, the rinsing water would be pressed past the sealing into the pump chamber, until an equilibrium is obtained between the rinsing water pressure, the contact force on the sealing as well as the pump medium pressure. In such a case rinsing plunger 35 will move downwards concurrently with the rinsing water flow past primary sealing 17.

As has already been mentioned in the introduction, one of the most important aspects of this invention is that the plunger sealings are to be arranged in such a way, that a considerably reduced wear on the plunger and on its sealings is attained, when liquids are pumped, which contain solid and/or wearing particles. This is achieved mainly by using a wiper, which works in the way described above as a primary sealing against the pump medium. Since wipers having the configuration shown in the drawings normally are not able to perform at pressure differences corresponding to the working pressure of the pump, according to the invention a pressure equilibrium of the combined primary sealing/wiper 17 by means of the rinsing water pressure, which is active in gap 22, has been achieved, and thus mainly the same pressure is used on either side of the wiper during the pump stroke. As an additional precautionary measure the rinsing water on the rear side of primary sealing/wiper 17 has a somewhat higher pressure than the pressure used in pump housing 5A, which prevents the pump medium from being pressed up into the spaces above the primary sealing, if the same possibly has been damaged. In a similar way also secondary sealing 18 will obtain a pressure equilibrium, when rinsing water having mainly the same pressure works on the front side of the sealing in space 23 as well as on the rear side of the same in gap 24. The object of a pressure equilibrium of secondary sealing 18 is partly to lower the wear of the secondary sealing and partly to minimize the frictional forces from the secondary sealing.

Since Pv>Pp, rinsing water can also be pressed past primary sealing/wiper 17 into the pump housing, at least initially during the pump stroke. In case it is desirable that this rinsing effect is to continue essentially during the entire pump stroke, this can be done by controlling the oil feeding to control cylinder 38 by means of a suitable dimensional restriction in conduit 86A.

POSITION V-VI

During the last phase of the movement of slide 60 to the left recess 67 in slide 60 will open up a connection between conduits 82A and 83A, which enables driving piston 12A in the A-unit to start its return stroke, position V. Since no work pressure is developed on driving piston 12A in driving chamber 42A, the pressure from conduit 84A, which essentially is obtained from return chamber 43B in the B-unit, will be sufficient to drive back driving piston 12A, the hydraulic medium from driving chamber 42A being drained to sump 70 via conduit 82A, recess 67 and draining conduit 83A.

When slide 60 has reached its left end position, it stays in this position thanks to the return pressure in conduit 89B, until driving piston 12B in the B-unit has moved forwards so far, that hydraulic medium can be drained from the right side of slide 60 through conduit 89B in the same way as has been described above with reference to the A-unit (position VI-VIII).

POSITION VI-VIII

Driving piston 12B moves at an even speed forwards in the same way as driving piston 12A did in the introductory part of the functional description. This phase for driving piston 12B of the B-unit is indicated by the dashed line-drawn, upper, planar curve in the diagram in FIG. 2A. At the same time driving piston 12A is driven in the return direction and pulls the plunger along and out of pump housing chamber 5A by means of driving rod 13A. Valve 4A is now closed and fresh pump medium is being sucked into pump housing chamber 5A via valve 3A. This phase continues, until driving piston 12B has advanced so far, that gap 52B has started communicating with conduit 89B and driving piston 12A has reached its upper end position, slide 60 now being able to be pushed to the right, position VIII.

During the return movement of plunger 10A driving chamber 42A is of course not pressurized. Hence, the rinsing chamber plunger can be returned to its starting position by means of return spring 36, control plunger 37 also being returned to its rear (upper) end position. Rinsing water is fed by pressure through conduit 32 past nonreturn valve 33, FIG. 1C, and on through rinsing water chamber 34, duct 26, gap 24, conduits 25 and 26, past valve 48 and out through draining conduit 39. Rinsing water chamber 34 is then filled with rinsing water, and at the same time gap 24 between sealing sleeves 18 and 19 is washed clean, possible impurities which come along with plunger 10A past sealing sleeves 17 and 18 being rinsed away from the system. However, substantially all the impurities are removed by means of main sealing 17, which in this phase functions as a wiper against the smooth, cylindrical outer side 16 of plunger 10A. Consequently, only insignificant amounts of impurities pass main sealing 17, provided sleeve 17 has not been damaged.

In case primary sealing/wiper 17 is damaged seriously, spaces 22, 30, 29 and 23, located above and close to the wiper will be isolated from the rest of the rinsing water system by means of secondary sealing 18 as well as nonreturn valve 28, which is closed during the suction stroke of the pump. In addition to that, as has already been mentioned, a rinsing of spaces and ducts above secondary sealing 18 is done.

Figure 2B:
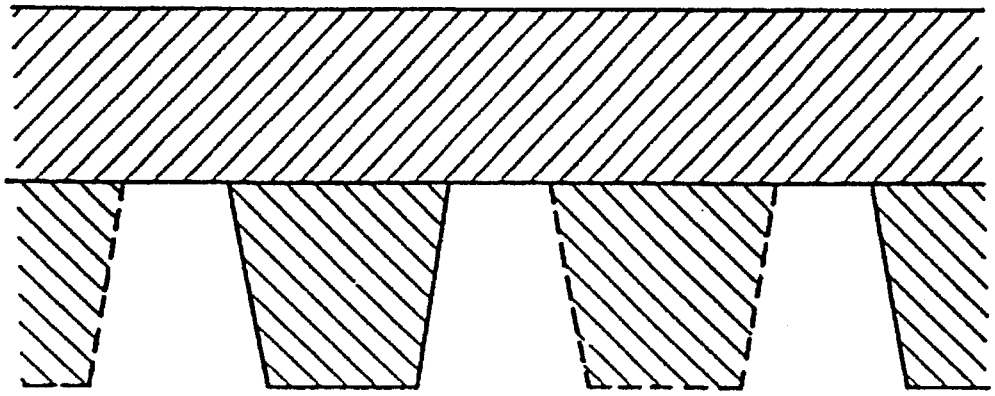

In the description given above of the function of pump units A and B there has not been any detailed description of how the series of openings 46A, 46B, 47A, 47B in hydraulic cylinders 11A and 11B influence the pump characteristics of the units. The effect of these openings will be that the movements of driving pistons 12A and 12B are suppressed in their end positions, which corresponds to the inclined portions in FIG. 2A. FIG. 2A also shows idealized chambers for the two pump units. In FIG. 2B the pressure stroke of the A- and the B-units have been combined to the upper curve. The result is in the idealized case a completely even flow of the pump medium from the integrated two-cylinder pump assembly, which also really mainly is achieved. The lower curve in FIG. 2B illustrates the corresponding conditions in the suction conduit of the integrated pump assembly. The discontinuous process in the suction conduit is considerably simpler to control and does not influence the even outflow from the pump. In practive, the pump characteristic does not have the shape of fully straight lines. However, between positions III and IV the curve is a mainly horizontal curve, the central position of the slide, FIG. 1B, defining a point of inflection on the curve.

Figure 3:
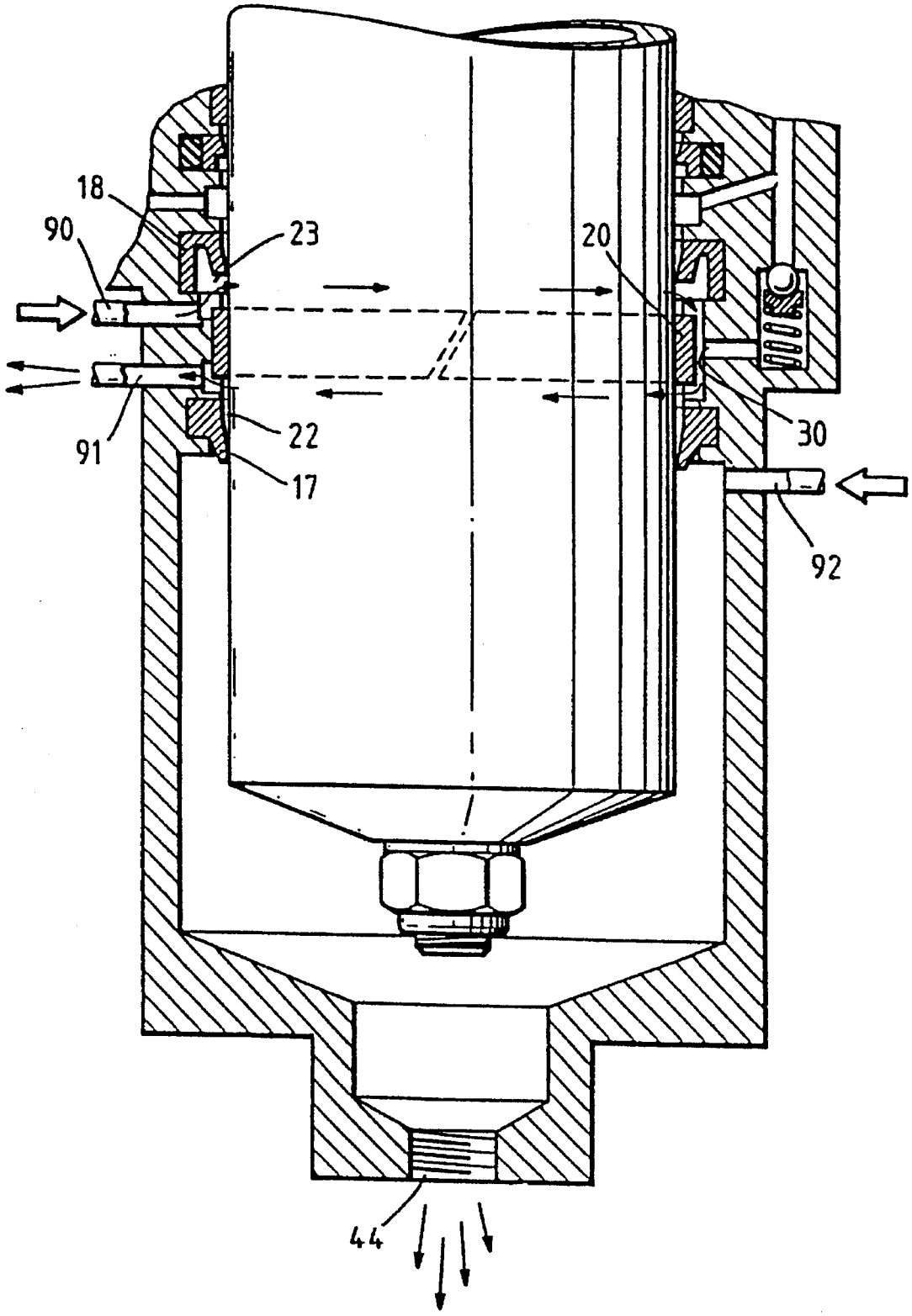
FIG. 3 shows schematically how a pump housing chamber with a pump housing cylinder and ancillary sealing devices can be cleaned, subsequent to the accomplished work.

Although sealing housing 6A is washed with rinsing water during two phases in each work cycle, it may be desirable to, when the work has been done, carefully clean sealing housing 6A and also pump housing 1A. This is particularly true, if strongly contaminating media have been pumped or media which for some other reason must be removed from the pump is order not to damage it, e.g. cement or other substances, which can harden and in the long run make the pump incapable of functioning. FIG. 3 illustrates how such a rinsing can be done. Two additional conduits 90 and 91 are used for this purpose, which extend through the rinsing water housing wall to annular space 23 in front of secondary sealing sleeve 18 and from annular gap 22 behind main sealing and wiper sleeve 17 respectively. Rinsing water is fed through conduit 90 to annular space 23 and flows through this space on each side of plunger 10A to its opposite side, from which side the water flows through passage 30 on the rear side of guide 20 and into annular gap 22. The water continues through gap 22 and passes again on each side of plunger 10A and is finally evacuated through draining conduit 91. In this way all possible impurities in spaces 22 and 23 are efficiently removed. If it is advantageous, rinsing water can also be fed through conduit 32 when the pump is inoperative in order to, via rinsing water chamber 34 and conduit 26, also clean gap 24, which is drained through conduit 39 in a way which has been explained in connection with the description of the return stroke of plunger 10A. Finally, pump housing chamber 5A can be washed with rinsing water, which is fed through a conduit 92 (possibly through the same conduit as the outlet conduit for the pump medium). A drain plug 93 has in this situation been removed and consequently, the rinsing water can be drained through bottom opening 94.

Figure 4:
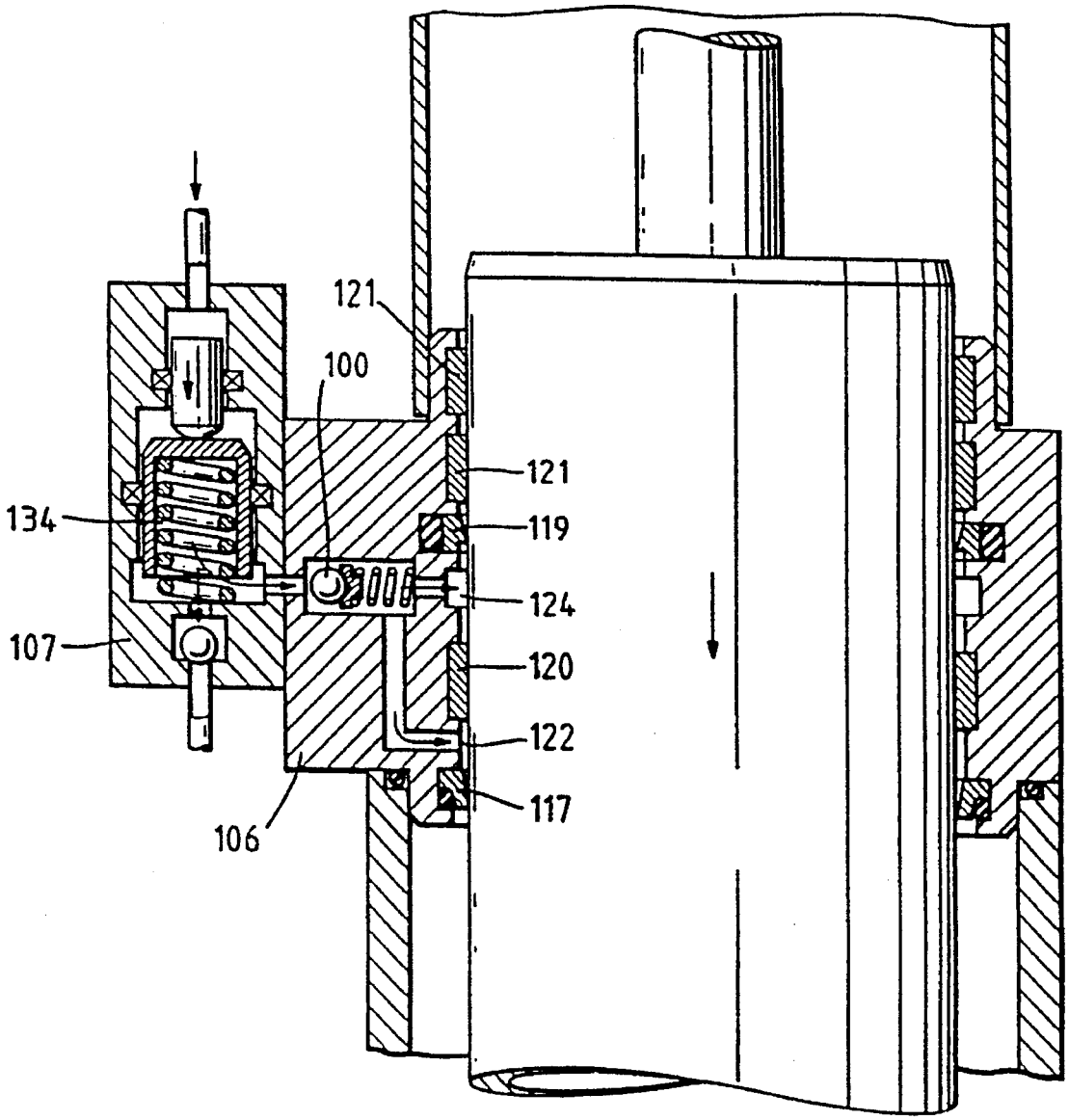
FIG. 4 shows a portion of a pump unit, which includes a sealing housing according to an alternative embodiment.

In the embodiment shown in FIG. 4 a rinsing water housing 107, designed in the same way as in the previous embodiment, and a modified sealing housing 106 is used. A draining housing and ancillary draining elements are not needed in this embodiment. The sealing housing contains a combined primary sealing and wiper 117, a second rear sealing 119 as well as guides 120 and 121. Sealing housing 106 also contains a non-return valve 100, the counterflow side of which is connected to a gap 122 on the rear side of primary sealing/wiper 117 and to an annular recess 124 between rear sealing 119 and first guide 120.

During the return stroke rinsing water chamber 134 is filled with rinsing water, which during the pump stroke is pressed out past valve 100 and into space 124 and gap 122, and in this way, in the same way as in the previous embodiment, impurities are essentially stopped from being pressed upwards past primary sealing/wiper 117 during the pump stroke. During the return stroke no rinsing takes place according to this embodiment. Non-return valve 100 stops during the return stroke possible impurities from passing into rinsing water chamber 134, when the latter is connected to the feed conduit for rinsing water.

A pump unit designed for a higher pump medium pressure, i.e. 100–300 bar, will now be explained, reference being made to FIG. 5. This pump unit can also be used for higher pressures than 300 bar, but according to the state of the art there are no hydraulic pumps on the market able to provide a pressure considerably higher than 300 bar, and consequently, 300 bar is a practical upper limit considering the state of the art.

Figure 5:
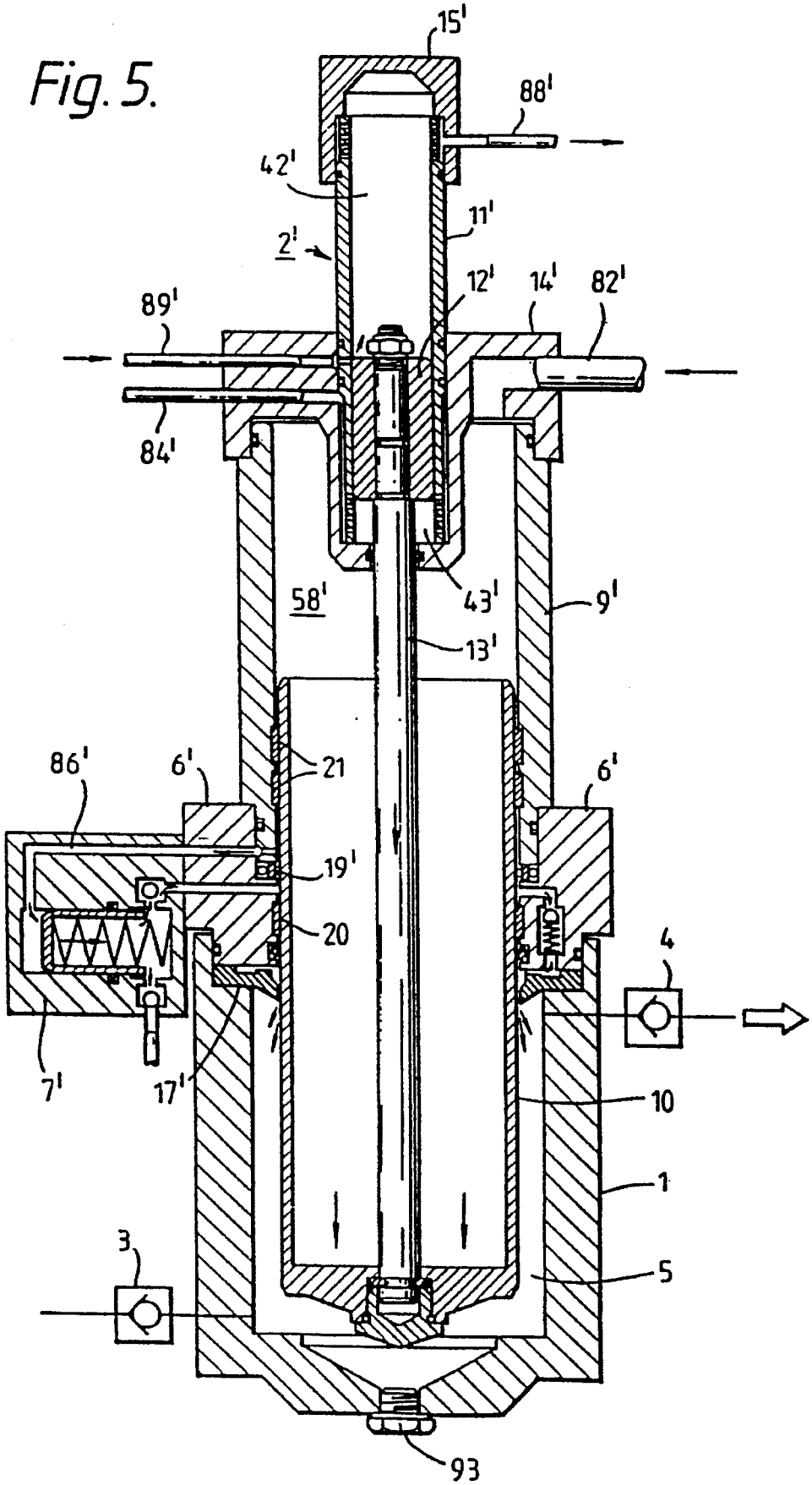
FIG. 5 illustrates a pump unit according to another embodiment of the invention, designed for a high medium pressure.

In FIG. 5 the same numerals are used for elements, which are exactly identical with the elements shown in FIG. 1A. Elements, which have counterparts in FIG. 1A but have been designed in a somewhat different way or which have a slightly different function, have been given the same numerals as in FIG. 1A but with a prime sign. Two pump units of the type shown in FIG. 5 are designed to be integrated into a plunger pump assembly in the same way as has been described above, a slide valve of the type described above being a part of the system and designed to control the shiftings of the two pump units. A hydraulic assembly H is also in this case a part of the equipment.

Each one of the two pump units, which are designed in the same way, comprises a pump housing 1, a hydraulic chamber housing 9' and a return unit 2'. Pump housing 1 contains a pump housing chamber 5 with an inlet conduit with a nonreturn valve 3 and an outlet conduit with a nonreturn valve 4. Pump housing 1 is connected to a sealing housing 6 and said hydraulic chamber housing 9'. Sealing housing 6' and hydraulic chamber housing 9' are integrated parts of pump housing 1 and constitute a continuation of cylinder-shaped pump housing chamber 5 but with smaller inner dimensions. A rinsing water housing 7' is connected to sealing housing 6'. A plunger 10 is used.

Return unit 2' comprises the following main elements: a return cylinder 11', a return piston 12', a return piston rod 13', which connects return piston 12' to plunger 10, an end block 14' and a top lid 15'. Elements 1, 6', 7', 9', 11', 14' and 15' are connected to each other by means of bolted joints to one single unit. In this stationary unit the unit which comprises plunger 10, return piston 12' and return piston rod 13' is movable between two end positions.

Plunger 10 has en even, cylindrical exterior side. It is designed to interact with a number of annular or sleeve-shaped sealings in sealing housing 6', which also is a part of the pump housing cylinder. Close to pump housing chamber 5 there is a first annular element, designed as a metallic rinsing water ring 17', which forms a narrow, gap-shaped rinsing water passage 94 against plunger 10. A first sealing sleeve, which constitutes a combined main sealing and wiper, is designated 18'. A secondary sealing ring 19' seals the spaces between rinsing water and the hydraulic medium, which hydraulic chamber 58' contains. Lower guides between sealing sleeves 17' and 18' are designated 20, and upper guides between sealing ring 18' and hydraulic chamber 58' are designated 21.

Elements 17'–21 are mounted in annular grooves in sealing housing 6. Also, the inner wall of sealing housing 6 has in its cross-section a profile, in which there is an annular space 24', **24*a*' between primary sealing 17' and secondary sealing 18'. Also, rinsing water ring 17' forms in its upper part an annular space 22' between gap 94 and primary sealing 18'**.

From rinsing water housing 7' a conduit 26' leads to annular spaces 24', **24*a*' and from these spaces a conduit 25' leads via a nonreturn valve 28' to an annular groove 25*a*' in the upper side of rinsing water ring 17'. Groove 25*a*' communicates via a gap 25*b*' with space 22'**.

An inlet conduit 32 for rinsing water extends via a non-return valve 33 into a rinsing water chamber 34, which communicates with above-mentioned conduit 26'. Rinsing water chamber 34 contains a rinsing plunger 35 having a screw-wound return spring 36 on the inner side. A non-return valve **26*a*' is mounted between rinsing water chamber 34 and conduit 26'**.

Rinsing plunger 35 can be moved by compressing return spring 36 by means of the hydraulic medium in a control chamber 38'. Control chamber 38' communicates with hydraulic chamber 58' through a conduit 86'.

Return piston rod 13' reduces the active surface on plunger 10 on the driving side. In rinsing water housing 7' the spring constant of return spring 36 is chosen to make rinsing water pressure Pv in rinsing water chamber 33 slightly lower than hydraulic pressure Ph but higher than pump medium pressure Pp during the pump stroke.

Unit 2' is designed partly to take care of the return stroke of plunger 10 and partly to guide the movements of plunger 10 in order to make the described pump unit interact with another similar pump unit in the pump assembly according to the movement pattern description in connection with the first embodiment. The slide valve shown in FIG. 1A and FIG. 1B is a very important element in this control function. The slide in this valve can according to the embodiment be moved by means of hydraulic pressure via a conduit 89', which can either work as a draining conduit, as is shown in FIG. 5, or as a control conduit, when piston 12' is in its upper position. The movements of piston 12' are caused by hydraulic oil from a pump through a control conduit 84', which communicates with a return chamber 43'. A draining chamber 42' is located above piston 12' and can be drained through a draining conduit 88'. The hydraulic fluid in hydraulic chamber 58' is fed and drained through a conduit 82'. Thus, the hydraulic fluid is directly acting on plunger 10 and not, as in the above-described embodiment, via a driving and return piston. Thus, in the now described embodiment piston 12' works solely as a return and draining piston. For the rest piston 10 follows the same movement progress as has been described above. Thus, only how the rinsing of the sealing elements is done according to this embodiment will be described here in more detail.

Figure 6:
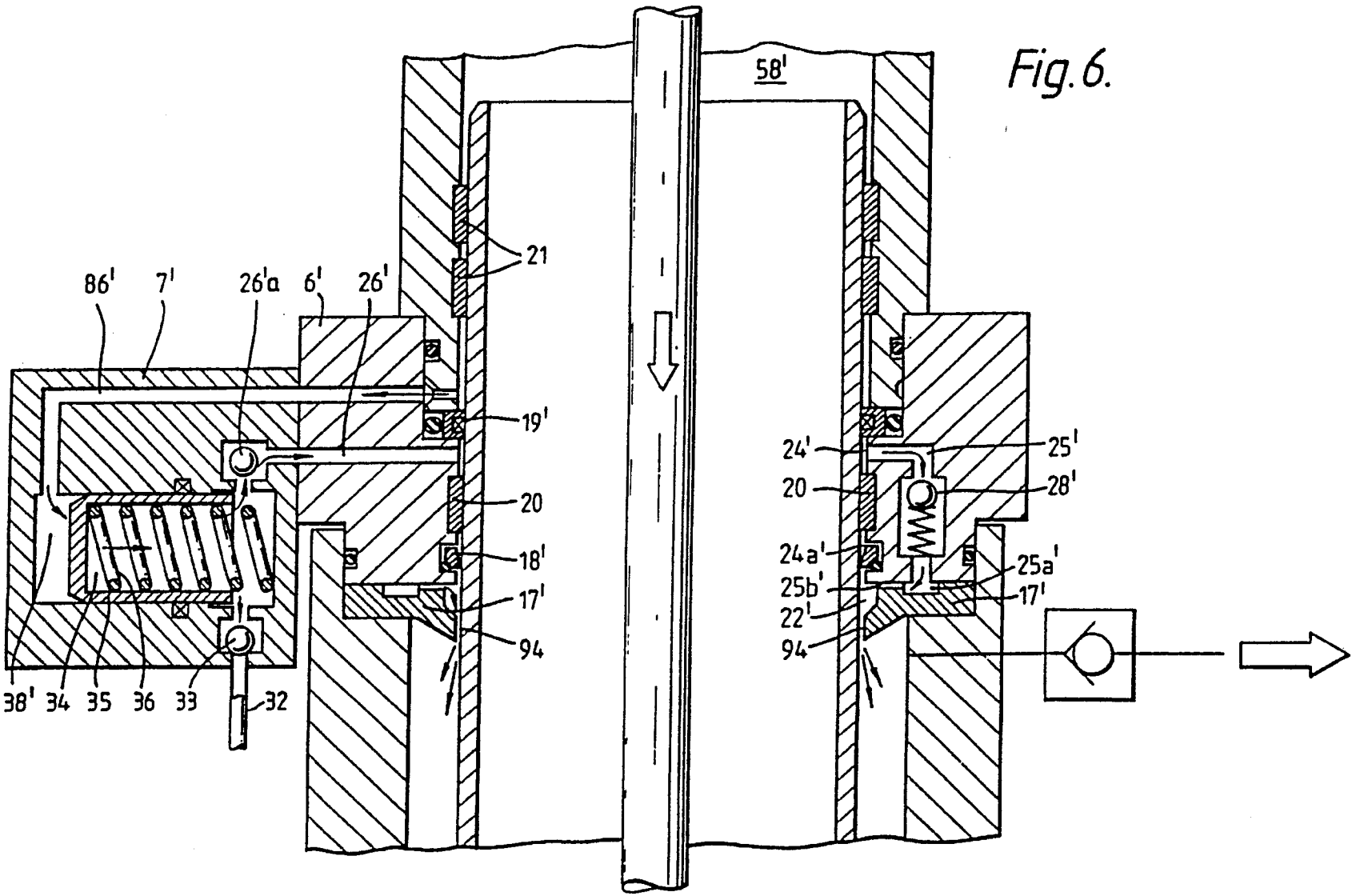
FIG. 6 shows parts of the unit according to FIG. 5 on an enlarged scale.

During the pump stroke, which is shown in FIG. 5 and FIG. 6, hydraulic oil is fed through conduit 82' into hydraulic chamber 58' and drives plunger 10 downwards. The hydraulic medium passes from hydraulic chamber 58' on and past guides 21 and conduit 86' into control chamber 38'. Pressure Ph drives rinsing plunger 35' and presses the rinsing water in rinsing water chamber 34' past valve **26*a*', via conduit 26' and into gap 24' and 24*a*'. From the latter the rinsing water passes through conduit 25', past valve 28' and into annular groove 25*a*' in rinsing water ring 17'. The rinsing water passes from this annular space 25*a*' through gap 25*b*' into space 22' in front of sealing sleeve 18' and flows out through gap 94 into pump housing cheer 5, plunger 10 being rinsed. Return spring 36 is simultaneously compressed. It has a suitable spring constant and in combination with a suitable surface on rinsing water plunger 35' a rinsing water pressure Pv can be obtained, which is larger than pump pressure Pp in pump housing chamber 5 but smaller than hydraulic pressure Ph during the pump stroke. During the return stroke valve 26*a*' is closed. Valve 33 is opened up instead. Rinsing water plunger 35' is returned by means of return spring 36, and fresh rinsing water flows into rinsing water cheer 33' through conduit 32. The hydraulic medium from control chamber 38' is returned via conduit 86' to hydraulic chamber 58'**.

Space 22', which is located in rinsing water ring 17' between gap 94 and primary sealing 18', is designed to form a rinsing water buffer between the pump medium and the primary sealing in order to reduce wear and damages to primary sealing/wiper 18'. It is to be noted that during the return stroke nonreturn valve 28' is closed, the rinsing water in spaces 22', **25*b*' and 25*a*' remaining during the entire return stroke in the spaces. Even if small amounts of the pump fluid can pass into space 22'** during the return stroke, it will be strongly diluted with rinsing water and is washed out during the next pump stroke.

I claim:

1. A pump assembly comprising:

a first and second pump unit each comprising a pump housing chamber, a pump housing cylinder and a displacement element movably mounted in said pump housing cylinder, said displacement element, during a pump stroke being driven into said pump housing chamber;

said first pump unit further comprising a first driving unit for the displacement element of said first pump unit, said first driving unit comprising a first hydraulic cylinder with a first driving piston in said hydraulic cylinder and a driving rod connecting said first driving piston with said displacement element;

said second pump unit further comprising a second driving unit for the displacement element of said second pump unit, said second driving unit comprising a second hydraulic cylinder with a second driving piston in said hydraulic cylinder and a driving rod connecting said second driving piston with said displacement element of said second pump unit;

said pump assembly further comprising:

a source of hydraulic medium;

a first hydraulic pump for supplying said first and second pump units with hydraulic medium under pressure; and a control valve common to said first and second pump units for controlling movement of the displacement element in said first and second pump units, said control valve having a valve housing with first and second ends and a slide having recesses and being movable in said valve housing between said first and second ends and positions therebetween for regulating flow of hydraulic medium from said first hydraulic pump to said first and second driving cylinders and from said first and second driving cylinders to said source of hydraulic medium;

a hydraulic main conduit connecting said first hydraulic pump with said control valve;

a first driving conduit connecting said control valve with a rear end of said first hydraulic cylinder;

a second driving conduit connecting said control valve with a rear end of second hydraulic cylinder;

a first return stroke conduit connecting a front end of said first driving cylinder with said source of hydraulic medium;

a second return stroke conduit connecting a front end of said second driving cylinder with said source of hydraulic medium;

a first hydraulic control conduit extending between a first regulation duct in said first hydraulic cylinder in an intermediate position between said rear end and said front end of said first hydraulic cylinder and a port in one of said first and second ends of said valve housing;

a second hydraulic control conduit extending between a second regulation duct in said second hydraulic cylinder in an intermediate position between said rear end and said front end of said second hydraulic cylinder and a port in the other of said first and second ends of said valve housing;

said first driving piston having a first driving piston duct connecting a port in the cylinder side of said first driving piston with a first hydraulic draining conduit;

said second driving piston having a second driving piston duct connecting a port in the cylindrical side of said second driving piston with a second hydraulic draining conduit;

said slide:

(i) in a first end position of said slide, connecting said hydraulic main conduit from said first hydraulic pump with said first driving conduit for driving said first driving piston during a pump stroke of said first pump unit and simultaneously connecting said second driving conduit with said source of hydraulic medium, (ii) in a second end position of said slide, connecting said hydraulic main conduit from said first hydraulic pump with said second driving conduit for driving said second driving piston during a pump stroke of said second pump unit and simultaneously connecting said first driving conduit with said source of hydraulic medium, and (iii) in an intermediate position between said first and second end positions, connecting said hydraulic main conduit from said first hydraulic pump with said first and second driving conduits for driving both said first and said second driving pistons;

wherein during a phase of said intermediate position of said slide in said control valve, one of said first and second driving pistons adopts an intermediate position between said rear and front ends of the respective hydraulic cylinder such that said first and second regulation ducts in said first and second hydraulic cylinders will communicate with said first or second driving piston ducts.

2. A pump assembly according to claim 1, wherein said control valve housing has a central port connected to said hydraulic main conduit, a first port for said first driving conduit on one side of said central part and a second port for said second driving conduit on the other side thereof, and wherein said slide has a central recess with a length such that said recess can connect, in first and second non-central positions of said slide in said valve housing, said main conduit with either of said first and second driving conduits, and in a third, central, position, can connect said first and second driving conduits and said main conduit with each other.

3. A pump assembly according to claim 2, wherein said control valve housing has a third port between said first port and one of said end ports, a fourth port between said second port and the other of said end ports, a first drainage conduit connecting said third port with said source of hydraulic medium, a second drainage conduit connecting said fourth port with said source of hydraulic medium, and wherein said slide has two non-central recesses, each being shorter than said central recess and located on said slide such that they, in an end position of said slide, may connect either of said first and second driving units with one of said first and second drainage conduits but not with any other conduits.

4. A pump assembly according to claim 1, wherein a restriction is provided in each of said control conduits.

5. A pump assembly according to claim 1, wherein a second hydraulic pump is provided to pump hydraulic medium from said source of hydraulic medium through first and second return stroke conduits to cause respective return strokes of said first and second driving pistons.

6. A pump assembly according to claim 1, wherein said displacement element is a plunger.

7. A pump assembly according to claim 1, wherein said displacement element is a piston.

8. A pump assembly according to claim 1, wherein said displacement element is a membrane.

* * * * *